US007907091B2

(12) United States Patent
Zhang

(10) Patent No.: US 7,907,091 B2
(45) Date of Patent: Mar. 15, 2011

(54) ANTENNAS

(75) Inventor: Yue Ping Zhang, Singapore (SG)

(73) Assignee: Nanyang Technological University, Singapore (SG)

( * ) Notice: Subject to any disclaimer, the term of this patent is extended or adjusted under 35 U.S.C. 154(b) by 197 days.

(21) Appl. No.: 12/161,137

(22) PCT Filed: Dec. 20, 2006

(86) PCT No.: PCT/SG2006/000398

§ 371 (c)(1),
(2), (4) Date: Jul. 16, 2008

(87) PCT Pub. No.: WO2007/084080

PCT Pub. Date: Jul. 26, 2007

(65) Prior Publication Data

US 2008/0316112 A1 Dec. 25, 2008

(51) Int. Cl.
*H01Q 1/38* (2006.01)

(52) U.S. Cl. ..... 343/700 MS

(58) Field of Classification Search ..... 343/700 MS, 343/741, 745, 752, 803, 804, 806
See application file for complete search history.

(56) References Cited

U.S. PATENT DOCUMENTS 4,924,236 A * 5/1990 Schuss et al. ..... 343/700 MS
5,003,318 A * 3/1991 Berneking et al. ..... 343/700 MS

FOREIGN PATENT DOCUMENTS

CA 2314449 A1 1/2002
JP 2001-053535 2/2001

* cited by examiner

*Primary Examiner* — Michael C Wimer
(74) *Attorney, Agent, or Firm* — Dickstein Shapiro LLP

(57) ABSTRACT

An antenna on a substrate, the antenna being symmetrical about a central longitudinal axis of symmetry, the antenna comprising a first portion that is substantially rectangular, a second portion that is substantially rectangular, the first portion and the second portion being spaced from each other and being operatively connected by an intermediate portion.

25 Claims, 8 Drawing Sheets

ANTENNAS

TECHNICAL FIELD

This invention relates to antennas and refers particularly, though not exclusively, to patch and microstrip antennas suitable for in-package use and having an improved bandwidth.

BACKGROUND

Driven by growing pressure to lower cost and to shrink physical volume, various microstrip antennas for antenna-in-package designs ("AiP") have been developed in the past few years for portable wireless radio transceivers. These include AiP designs:

(a) suitable for multi-chip solutions for wireless radio transceivers;
(b) with both active and parasite microstrip patch antennas suitable for multi-chip solutions for wireless radio transceivers;
(c) with a microstrip patch antenna suitable for multi-chip solutions for wireless radio transceivers;
(d) with a microstrip patch antenna suitable for single-chip solutions for wireless radio transceivers;
(e) using an inverted-F antenna suitable for multi-chip solutions for wireless radio transceivers; and
(f) using an inverted-F antenna for multi-chip solutions for wireless radio transceivers.

The existing AiP designs have serious drawbacks:

(1) AiP designs using microstrip patch antennas can have fractures and warping if they are implemented in low temperature, co-fired ceramic ("LTCC") technology;
(2) AiP designs using inverted-F antennas have to two-dimensionally integrate with multi-chip radios. As such they need a larger footprint on printed circuit boards ("PCB"); and
(3) they are designed for single-ended signal operation requiring complex conversion circuits to link to highly-integrated radios where differential signal operation is preferred.

SUMMARY

An antenna on a substrate, the antenna being symetrical about a central longitudinal axis of symmetry, the antenna comprising a first portion that is substantially rectangular, a second portion that is substantially rectangular, the first portion and the second portion being spaced from each other and being operatively connected by an intermediate portion.

The first portion may comprise a first sub-portion and a second sub-portion, the first sub-portion and the second sub-portion being spaced apart and being aligned on an axis perpendicular to the axis of symmetry. The first sub-portion and the second sub-portion may be separated by a capacitive portion of the antenna. The intermediate portion may be operatively connected to both the first sub-portion and the second sub-portion. The capacitive portion may extend into the first portion from an outer edge of the first portion to form the first sub-portion and the second sub-portion.

The intermediate portion may be substantially parallel to the axis of symmetry, and substantially perpendicular to both the first portion and the second portion. The first portion and the second portion may be substantially identical.

The antenna may be a stripline antenna; and the first portion, the second portion and the intermediate portion may comprise a ribbon radiating element. The capacitive portion may comprise two first elements, the two first elements being parallel, spaced apart, and both being parallel to the axis of symmetry. A first feed line for the antenna may be operatively connected to one of the two first elements. A second feed line may be operatively connected to a second of the two first elements.

The intermediate portion may comprise two intermediate elements being spaced apart from each other, parallel to each other, and parallel to the axis of symmetry.

The first portion and the second portion may each comprise:

an outer edge element,
end elements at and operatively connected to each end of the outer edge elements,
each end element extending substantially perpendicularly to the outer edge element; and
inner edge elements operatively connected to the end elements and extending substantially perpendicularly to the end elements.

The two intermediate elements may intersect and may be operatively connected to each inner edge element; and each inner edge element may have a gap therein extending between the two intermediate elements. A spacing of the two intermediate elements may be less than a spacing of the end elements of the first portion and the end elements of the second portion. The outer edge element of the first portion may have an opening therein aligned with and of the same transverse length as the spacing of the two first elements.

The antenna may further comprise a projection element extending into the second portion from the outer edge element of the second portion. The projection element may have a void therethrough, the void being centered on the axis of symmetry. The projection element may extend inwardly from the outer edge element of the second portion such that an inner end of the projection elements is substantially aligned with an inner edge of the inner edge element of the second portion.

The second portion may comprise a third sub-portion and a fourth sub-portion, the third sub-portion and the fourth sub-portion being spaced apart and being aligned on an axis perpendicular to the axis of symmetry. The third sub-portion and the fourth sub-portion may be separated by the projection element. The intermediate portion may be operatively connected to both the third sub-portion and the fourth sub-portion. The projection element may extend into the second portion from the outer edge element of the second portion to form the third sub-portion and the fourth sub-portion.

The ribbon radiating element may be of substantially constant width along its length.

The first elements may extend inwardly from the outer edge element of the first portion such that an inner end of each of the first elements is substantially aligned with an outer edge of the inner edge element of the first portion.

The antenna may further comprise a ground plane having two holes for the first feed line and the second feed line, the first and second feed lines passing through the substrate from the first elements to the ground plane. Alternatively, the antenna may further comprise a ground plane having a hole for the first feed line, the first feed line passing through the substrate from the first element to the ground plane.

The antenna may further comprise a dielectric material on the substrate, the antenna being formed in a manner selected from: on the dielectric material, and in the dielectric material.

The first portion, second portion and intermediate portion may comprise a driven element. The driven element may be outside a ribbon of exposed dielectric material. The antenna may further comprise parasitic elements within the ribbon of exposed dielectric material, the parasitic elements being operatively connected to the driven elements by capacitive coupling.

According to a second aspect there is provided an antenna-in-package comprising the antenna described above. The antenna-in-package may further comprise a semiconductor chip mounted beneath the ground plane; the semiconductor chip having connects that are operatively connected to at least one of: the first feed line, and the first and second feed lines.

BRIEF DESCRIPTION OF THE DRAWINGS

In order that the invention may be clearly understood and readily put into practical effect there shall now be described by way of non-limitative example only exemplary embodiments, the description being with reference to the accompanying illustrative drawings. In the drawings.

DETAILED DESCRIPTION OF THE EXEMPLARY EMBODIMENTS

The exemplary embodiments have new radiating elements and new ground-plane structures, and new integration with AiP designs in LTCC technology. The antennas described and illustrated may be used as stand-alone antennas and/or may be integrated into AiP designs in a two or three dimensional manner. They may be used for single and multi-band applications.

In the market, there are several LTCC material systems. For example, there are those of E. I. DuPont Nemours and Co of Wilmington, Del., USA as shown in Table 1:

TABLE 1

| PROPERTY | VALUE |
|---|---|
| Thickness 1) | |
| 951-AX | 205 μm |
| 951-A2 | 130 μm |
| 951-AT | 90 μm |
| 951-C2 | 40 μm |
| Dielectric constant | 7.8 (10 MHz) |
| Dissipation factor | 0.15% (10 MHz) |
| Insulation resistance | $>10^{12}\Omega$(100 VDC) |
| Breakdown voltage | >1000 V/25 μm |
| Colour | blue |
| Thermal conductivity | 3 W/mK |
| Thermal expansion | 5.8 ppm/K (25 . . . 300° C.) |
| Fired density | 3.1 g/cm$^3$ |
| Flexural strength | 320 Mpa |

Figure 1:
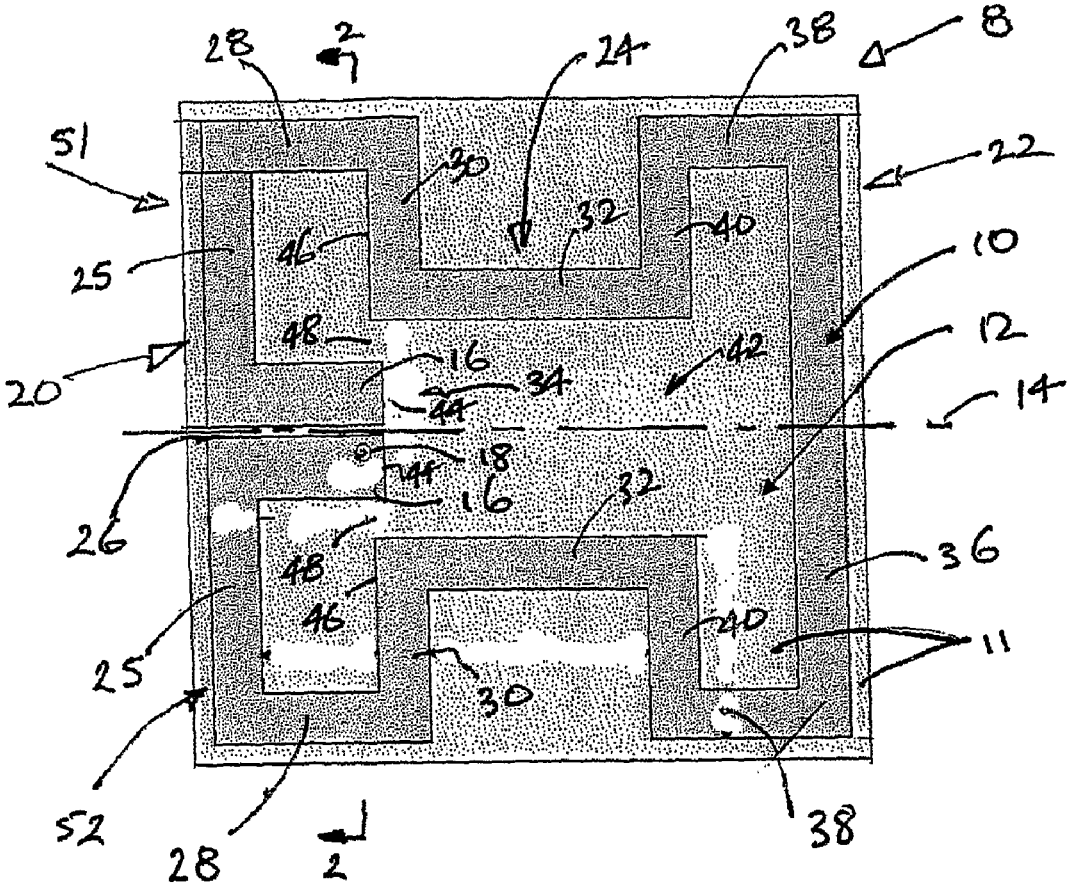
FIG. 1 is a top view of an exemplary embodiment.
Figure 2:
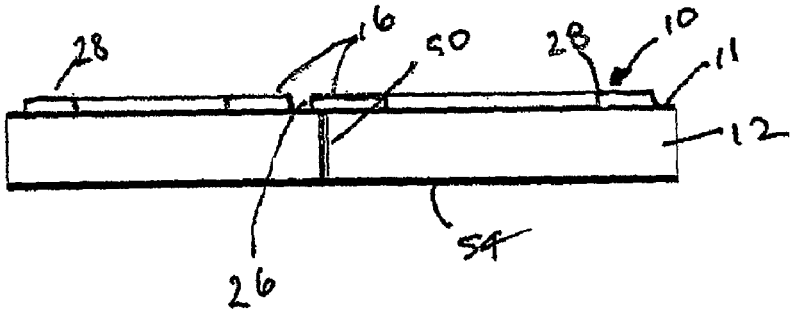
FIG. 2 is a vertical cross section along the lines and in the direction of arrows 2-2 on FIG. 1.

FIGS. 1 and 2 show an exemplary embodiment of a stripline antenna 8 that has a ribbon radiating element 10 mounted on or in a dielectric material 11, all on a substrate 12. The dielectric material 11 may be an LTCC material, liquid crystal polymer, or any other suitable dielectric material. The substrate 12 may be of any suitable material. The ribbon radiating element 10 is a conductive metal such as, for example, copper.

The ribbon radiating element 10 is symmetrical about a central, longitudinal axis of symmetry 14. On each side of, and parallel to, the axis of symmetry 14 are two first elements 16 that are parallel to each other and spaced apart. The two first elements 16 form the capacitive portion of the antenna 8, the remainder of the ribbon radiating element 10 forming the inductive portion of the antenna 8. Feed to the radiating element 10 is at a feed connection 18 in one of the first elements 16.

The ribbon radiating element 10 is generally formed by first and second portions 20, 22 respectively that are spaced-apart and substantially rectangular, and an intermediate portion 24. The first and second portions 20, 22 are joined by the intermediate portion 24. The intermediate portion 24 is substantially parallel to the axis of symmetry 14, and perpendicular to both the first and second portions 20, 22.

By substantially rectangular is meant that the shape approximates a rectangle, and may have curved corners rather than square corners. The four sides do not have to be exactly straight and may be slightly curved.

The first portion 20 has an outer edge element 25 from which the two first elements 16 extend. The two first elements 16 are operatively connected to and are generally perpendicular to the outer edge element 25, with the outer edge element 25 having an opening 26 aligned with and of the same extent in the transverse direction (i.e. perpendicular to the axis of symmetry 14) as the spacing of the two first elements 16. At each end of the outer edge element 25 and being operatively connected to the outer edge element 25 are two end elements 28 that are also generally perpendicular to the outer edge element 25.

Extending transversely of the end elements 28 is an inner edge element 30 that is operatively connected to the end elements 28 and generally perpendicular to the end elements 28.

The two first elements 16 extend into the first portion 20 such that their inner ends 44 are somewhat aligned with the outer edge 46 of inner edge element 30, but are spaced from the corners 48 of the inner edge element 30 and the intermediate elements 32. The two first elements 16 divide the first portion 20 into two sub-portions 51, 52 that are spaced apart by the two first elements 16 and are transversely aligned—aligned on an axis transverse to the axis of symmetry 14. In this way the two intermediate elements 32 are operatively connected to and perpendicular to the respective sub-portions 51, 52.

The intermediate portion 24 has two intermediate elements 32 that are operatively connected to and generally perpendicular to the inner edge element 30. The intermediate elements 32 are parallel to and equally spaced from the axis of symmetry 14. The inner edge element 30 has a gap 34 that extends between the two intermediate elements 32.

The second portion 22 is substantially identical to the first portion 20 (on the basis that the two first elements 16 do not form part of the first portion 20) and also has an outer edge element 36. At each end of the outer edge element 36 and being operatively connected to the outer edge element 36 are two end elements 38 that are also generally perpendicular to the outer edge element 36.

Extending transversely of the end elements 38 is an inner edge element 40 that is operatively connected to the end elements 38 and generally perpendicular to the end elements 38. The two intermediate elements 32 are operatively connected to and generally perpendicular to the inner edge element 40. The inner edge element 40 has a gap 42 extending between the two intermediate elements 32.

The ribbon radiating element 10 is preferably of constant width throughout its length. It is preferably formed on the dielectric 11 by any suitable technique such as, for example, printing.

Figure 7:
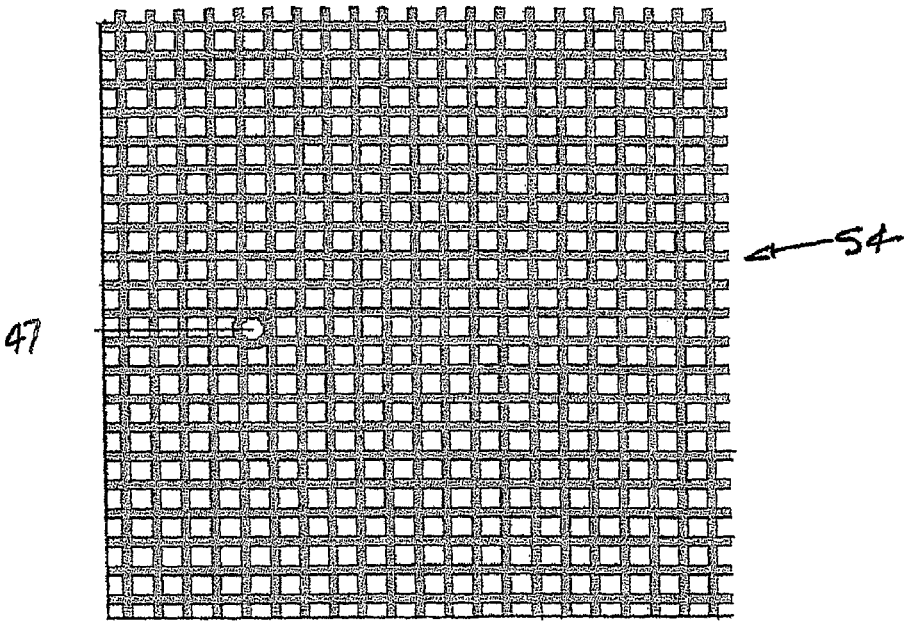
FIG. 7 is a top view of an exemplary ground plane.

The feed connection 18 is for a feed line 50 that passes through the substrate 12 and dielectric 11 as well as a hole 47 in a ground plane 54 (FIG. 7). The ground plane 54 is a preferably a rectangular or square grid structure, as shown.

In one particular form of the exemplary embodiment of FIGS. 1 and 2, the resonant frequency is at 5.78 GHz; $S_1$, is about −11.29 dB; bandwidth is 50 MHz (5.76 GHz-5.81 GHz); gain is 4.8 dBi; efficiency is 80%, the pattern is quasi omni-directional.

Figure 3:
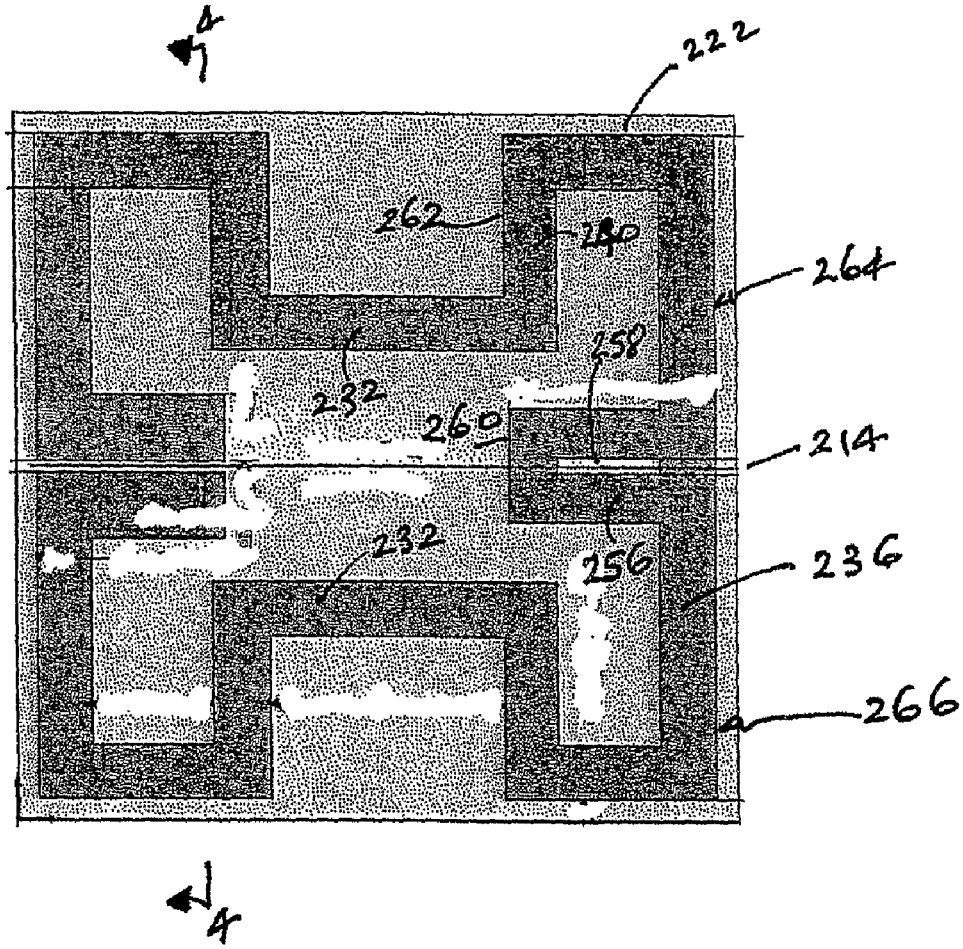
FIG. 3 is a top view of another exemplary embodiment.
Figure 4:
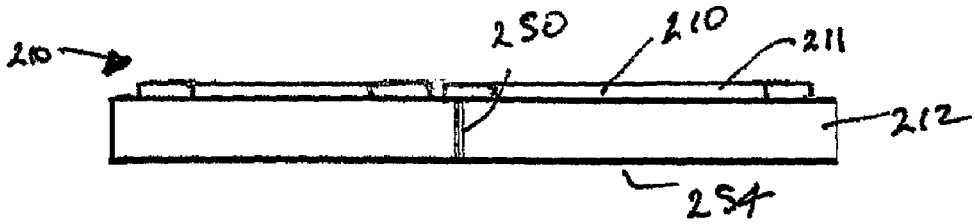
FIG. 4 is a vertical cross section along the lines and in the direction of arrows 4-4 on FIG. 3.

FIGS. 3 and 4 show another exemplary embodiment. The same reference numerals are used as for the embodiment of FIGS. 1 and 2 but with a prefix number 2. Here, the difference over the exemplary embodiment of FIGS. 1 and 2 is the addition of a projection element 256 that extends into the second portion from the outer edge element 236. The projection element 256 is operatively connected to and is generally perpendicular to the outer edge element 236. The projection element 256 has an elongate and centrally-located void 258 therethrough that is centered on the axis of symmetry 214. The projection element 256 extends into the second portion 222 such that its inner end 260 is somewhat aligned with the inner edge 262 of inner edge element 230, but the projection element 256 is spaced from the intermediate elements 232. The projection element 256 divides the second portion 222 into two sub-portions 264, 266 that are spaced apart by the projection element 256 and are transversely aligned—aligned on an axis transverse to the axis of symmetry 214. In this way the two intermediate elements 232 are operatively connected to and perpendicular to the respective sub-portions 264, 266.

By the addition of the projection element 256 the bandwidth of the antenna 208 is increased as it creates a longer and U-shaped current flow path of a width that is preferably substantially the same as the ribbon radiating element 210.

A particular exemplary form of the exemplary embodiment of FIGS. 3 and 4 has a resonant frequency at 5.775 GHz; $S_{11}$ is around −12.3 dB; a bandwidth of 70 MHz (bandwidth 5.74 GHz to 5.81 GHz); gain is 4.75 dBi; efficiency is 83%; and the pattern is quasi omni-directional.

Figure 5:
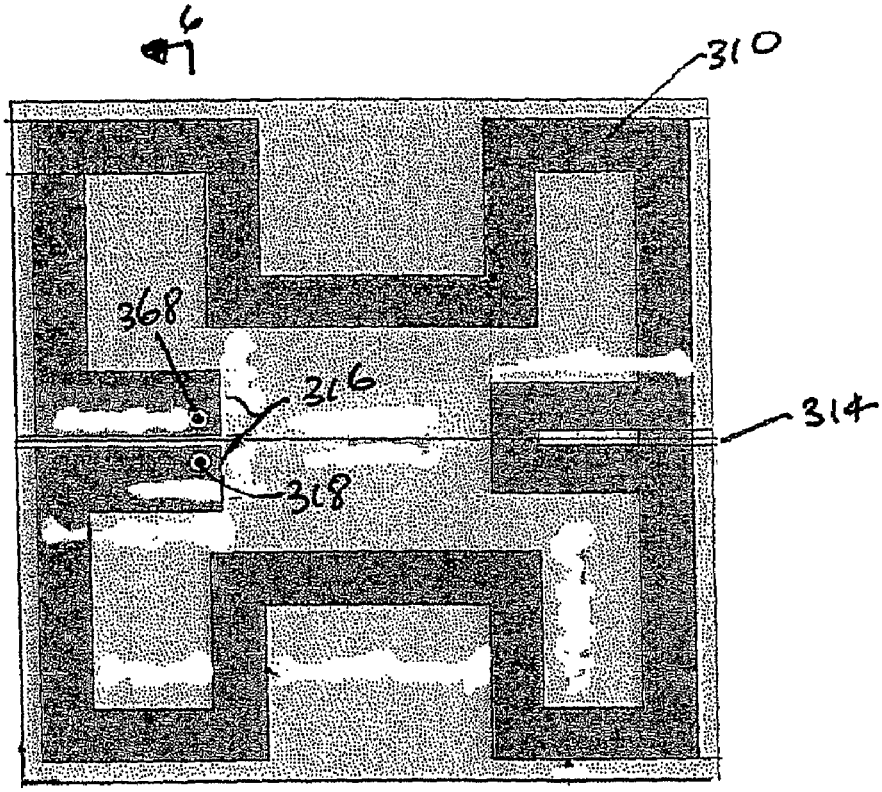
FIG. 5 is a top view of a further exemplary embodiment.
Figure 6:
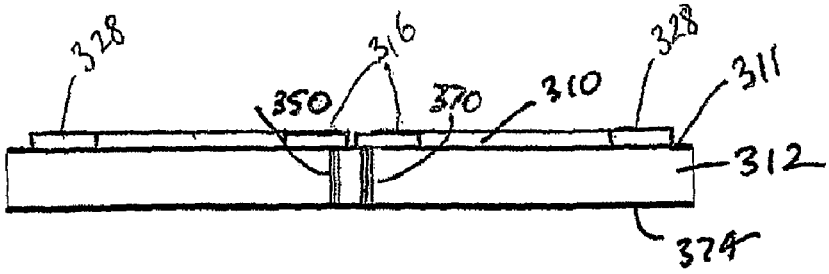
FIG. 6 is a vertical cross section along the lines and in the direction of arrows 6-6 on FIG. 5.
Figure 8:
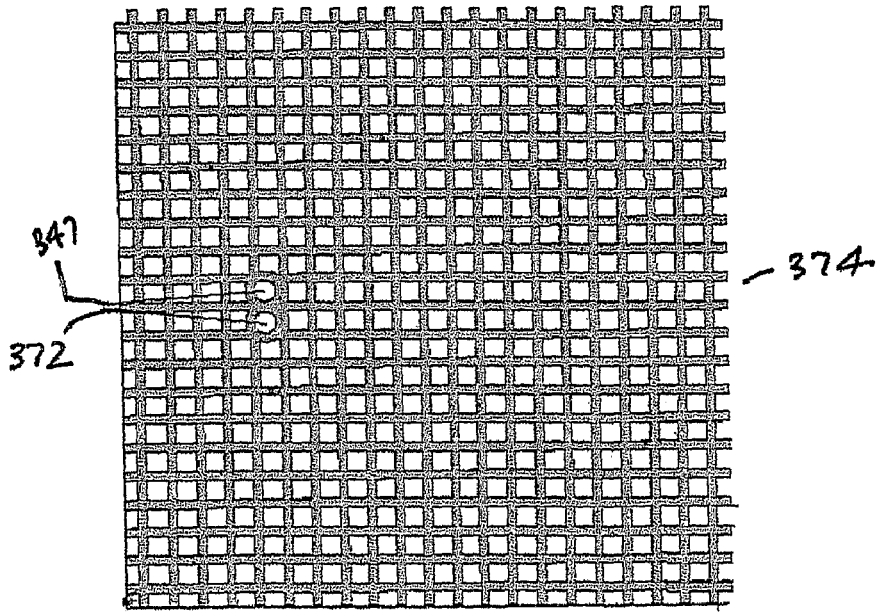
FIG. 8 is a top view of another exemplary ground plane.

The exemplary embodiments of FIGS. 1 and 2, and FIGS. 3 and 4, are suitable for single-ended signal operation. By the addition of a second feed line and connection they become suitable for differential signal operation. FIGS. 5 and 6 show the embodiment of FIGS. 3 and 4 with dual-feed for differential signal operation. Again the same reference numerals are used for like components but with the addition of a prefix number 3. A second feed to the radiating element 310 is at a second feed connection 368 in the second of the first elements 316. The second feed connection 368 is for a second feed line 370 that passes through the substrate 312, dielectric 311 and a second hole 372 in the ground plane 374 (FIG. 8). The second feed connection 368 and second feed line 370 may also be used with the embodiment of FIGS. 1 and 2 in a similar manner.

By using the ribbon radiating element 210 of exemplary embodiment of FIGS. 3 and 4 with the ground-plane 54 of FIG. 7 in a particular form of the exemplary embodiments it is possible to obtain a single-ended antenna with a resonant frequency at 5.77 GHz; $S_{11}$ of about −16.5 dB; bandwidth of 110 MHz (5.72 GHz to 5.83 GHz); gain of 4.4 dBi; efficiency of 83%; and a pattern that is quasi omni-directional.

Similarly, using the ribbon radiating element of FIGS. 5 and 6 with the ground-plane 374 of FIG. 8 in a particular form of the exemplary embodiments it is possible to obtain a differential LTCC chip antenna.

Figure 9:
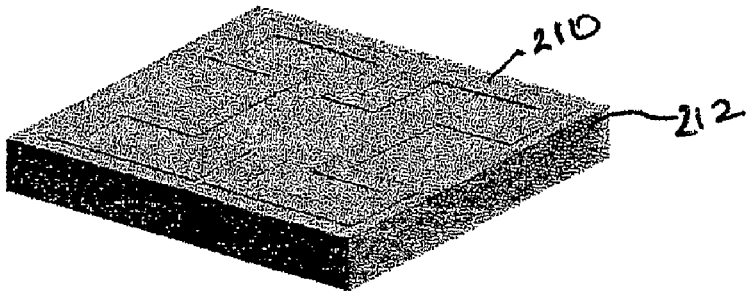
FIG. 9 is a top view of an exemplary integration of the antenna of FIGS. 3 and 4 in an AiP.
Figure 10:
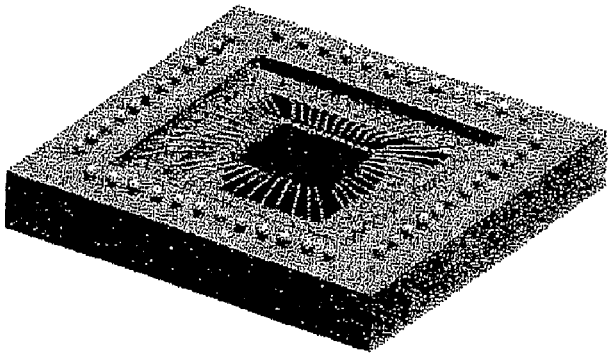
FIG. 10 is a bottom view of the exemplary integration of the antenna of FIG. 9.
Figure 11:
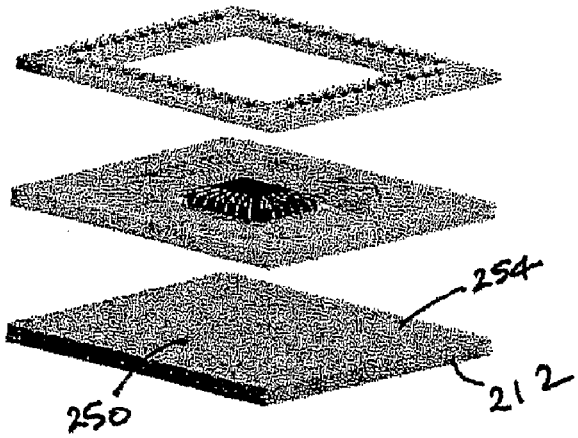
FIG. 11 is an exploded bottom view of the exemplary integration of the antenna of FIGS. 9 and 10.
Figure 12:
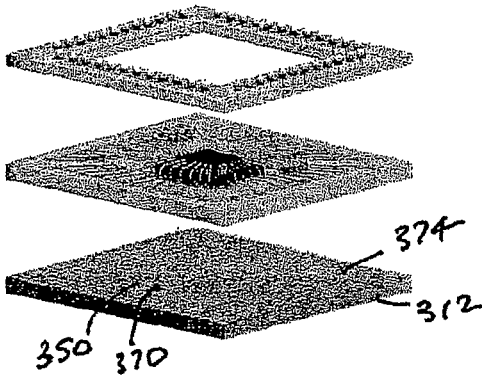
FIG. 12 is an exploded bottom view of the exemplary integration of the antenna of FIGS. 9 and 10 but for dual feed.

FIGS. 9 to 11 show integration of the antenna of the exemplary embodiment of FIGS. 3 and 4 into an AiP design. The design as shown is for single-ended operation and has two deep resonances seen from $S_{11}$: one is about −12.3 dB at 5.64 GHz and the other is −12.4 dB at around 5.82 GHz. Between the two deep resonances, the $S_{11}$ is below −10 dB and the bandwidth is more than 240 MHz (5.60 GHz to 5.84 GHz). The gain is 4.7 dBi, efficiency is 80%, and the pattern is quasi omni-directional. FIG. 12 shows an AiP design with dual feed for differential operation.

Figure 13:
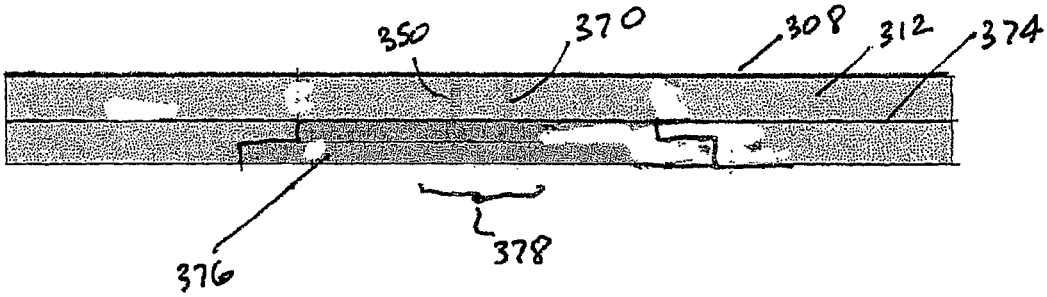
FIG. 13 is a side view of the exemplary integration of the antenna of FIG. 12.
Figure 14:
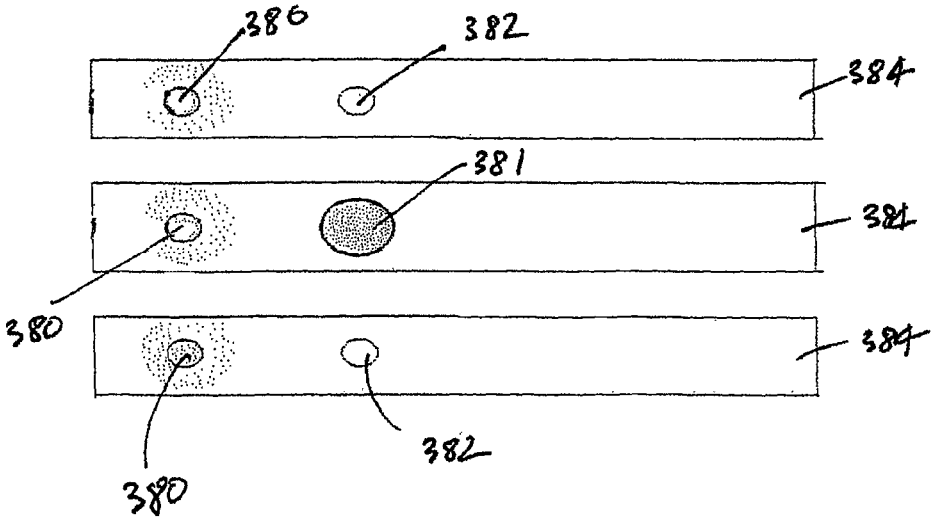
FIG. 14 is an illustration of the antenna feeding network for the embodiment of FIG. 12.

FIGS. 13 and 14 show the feeding network used in integration. The antenna 308, substrate 312 and ground 374 are for the exemplary embodiment of FIGS. 5 and 6. They are mounted on and integrated with a semiconductor chip 376 with the semiconductor chip 376 being beneath the ground plane 374. The feed lines 350, 370 connect with connects 378 of the chip 376. The feeding network of FIG. 14 has connection balls 380 for connection with a PCB, feed via 381 to the antenna 308, and short (that is, connecting one ground to another ground) vias 382. The ends 384 are for connection to the chip 376.

Figure 15:
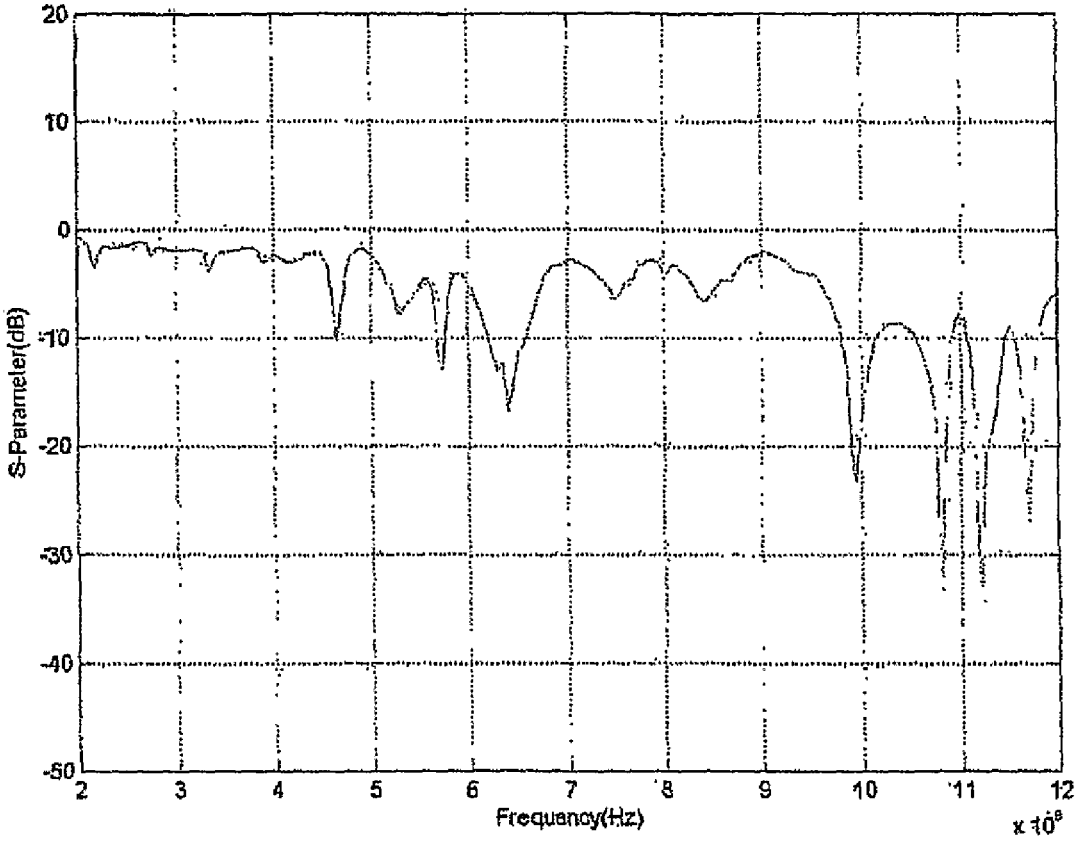
FIG. 15 is a graph of the S11 of the embodiment of FIGS. 1 and 2.

The measured results shown in FIG. 15 shows the performance of AiP designs incorporating for single-ended signal operation.

Figure 16:
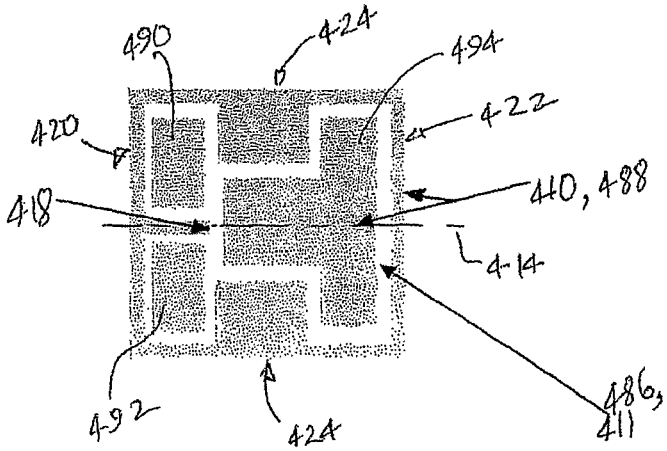
FIG. 16 is a top view of a penultimate exemplary embodiment.
Figure 17:
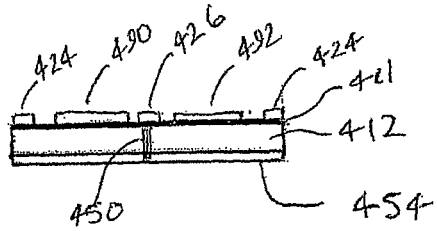
FIG. 17 is a vertical cross-section along the lines and in the direction of arrows 17-17 on FIG. 16.

As shown in FIGS. 16 and 17, complementary designs may also be used where the antenna 408 is formed as a slot antenna so that the "ribbon" 486 is actually a gap in the metal to expose the dielectric 411. The metal is formed outside the "ribbon" 486 as well as within the "ribbon" 486. The region outside the "ribbon" 486 is a driven element 488 of the antenna 408 as the feed connection 418 is in metal formed in the metalized "gap" 426. The driven element 488 is a radiating element and is generally formed by first and second portions 420, 422 respectively that are spaced-apart and substantially rectangular, and an intermediate portion 424. The first and second portions 420, 422 are joined by the intermediate portion 424. The intermediate portion 424 is substantially parallel to the axis of symmetry 414, and perpendicular to both the first and second portions 420, 422.

Within the "ribbon" 486 are three parasitic elements 490, 492 and 494 all of which are driven by the driven element 488 by capacitive coupling.

Figure 18:
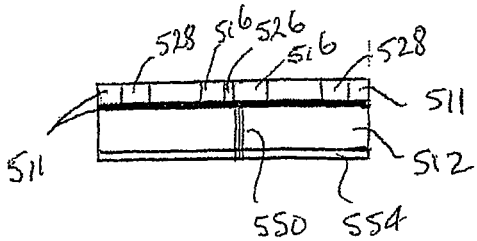
FIG. 18 is a vertical cross-sectional view corresponding to FIG. 1 but of a final exemplary embodiment.

In FIG. 18, the ribbon 510 and the dielectric 511 are coplanar and the ribbon 510 is formed in the dielectric 511 rather than on the dielectric 511, as is shown in FIGS. 2, 4 and 6. This form may also be used for the exemplary embodiment of FIGS. 16 and 17.

Whilst there has been described in the foregoing description preferred embodiments of the present invention, it will be understood by those skilled in the technology concerned that many variations in details of design, construction and/or operation may be made without departing from the present invention.

The invention claimed is:

1. An antenna on a substrate, the antenna being symmetrical about a central longitudinal axis of symmetry, the antenna comprising:

a first portion that is substantially rectangular;

a second portion that is substantially rectangular;

the first portion and the second portion being spaced from each other and being operatively connected by an intermediate portion;

the first portion comprising a first sub-portion and a second sub-portion, the first sub-portion and the second sub-portion being spaced apart and separated by a capacitive portion of the antenna;

wherein the antenna is a stripline antenna; and the first portion, the second portion and the intermediate portion comprise a ribbon radiating element, and wherein the capacitive portion comprises two first elements, the two first elements being parallel, spaced apart, and both being parallel to the axis of symmetry.

2. An antenna as claimed in claim 1, wherein the first sub-portion and the second sub-portion are aligned on an axis perpendicular to the axis of symmetry.

3. An antenna as claimed in claim 1, wherein the intermediate portion is operatively connected to both the first sub-portion and the second sub-portion.

4. An antenna as claimed in claim 1, wherein the capacitive portion extends into the first portion from an outer edge of the first portion to form the first sub-portion and the second sub-portion.

5. An antenna as claimed in claim 1, wherein the intermediate portion is substantially parallel to the axis of symmetry, and substantially perpendicular to both the first portion and the second portion.

6. An antenna as claimed in claim 1, wherein the first portion and the second portion are substantially identical.

7. An antenna as claimed in claim 1, wherein a first feed line for the antenna is operatively connected to one of the two first elements and a second feed line is operatively connected to a second of the two first elements.

8. An antenna as claimed in claim 1, wherein the intermediate portion comprises two intermediate elements being spaced apart from each other, parallel to each other, and parallel to the axis of symmetry.

9. An antenna as claimed in claim 1, wherein the first portion and the second portion each comprise:

an outer edge element, end elements at and operatively connected to each end of the outer edge elements, each end element extending substantially perpendicularly to the outer edge element; and inner edge elements operatively connected to the end elements and extending substantially perpendicularly to the end elements.

10. An antenna as claimed in claim 9, wherein the two intermediate elements intersect and are operatively connected to each inner edge element; each inner edge element having a gap therein extending between the two intermediate elements; a spacing of the two intermediate elements being less than a spacing of the end elements of the first portion and the end elements of the second portion.

11. An antenna as claimed in claim 1, wherein the first portion and the second portion each comprise:

an outer edge element, end elements at and operatively connected to each end of the outer edge elements, each end element extending substantially perpendicularly to the outer edge element; and inner edge elements operatively connected to the end elements and extending substantially perpendicularly to the end elements;

the outer edge element of the first portion having an opening therein aligned with and of the same transverse length as the spacing of the two first elements.

12. An antenna as claimed in claim 9 further comprising a projection element extending into the second portion from the outer edge element of the second portion; the projection element having a void therethrough, the void being centered on the axis of symmetry.

13. An antenna as claimed claim 11, further comprising a projection element extending into the second portion from the outer edge element of the second portion; the projection element having a void therethrough, the void being centered on the axis of symmetry.

14. An antenna as claimed in claim 12, wherein the projection element extends inwardly from the outer edge element of the second portion such that an inner end of the projection elements is substantially aligned with an inner edge of the inner edge element of the second portion.

15. An antenna as claimed in claim 12, wherein the second portion comprises a third sub-portion and a fourth sub-portion, the third sub-portion and the fourth sub-portion being spaced apart and being aligned on an axis perpendicular to the axis of symmetry; the third sub-portion and the fourth sub-portion being separated by the projection element.

16. An antenna as claimed in claim 15, wherein the intermediate portion is operatively connected to both the third sub-portion and the fourth sub-portion.

17. An antenna as claimed in claim 15, wherein the projection element extends into the second portion from the outer edge element of the second portion to form the third sub-portion and the fourth sub-portion.

18. An antenna as claimed in claim 1, wherein the ribbon radiating element is of substantially constant width along its length.

19. An antenna as claimed in claim 11, wherein the first elements extend inwardly from the outer edge element of the first portion such that an inner end of each of the first elements is substantially aligned with an outer edge of the inner edge element of the first portion.

20. An antenna as claimed in claim 7 further comprising a ground plane having two holes for the first feed line and the second feed line, the first and second feed lines passing through the substrate from the first elements to the ground plane.

21. An antenna as claimed in claim 7 further comprising a ground plane having a hole for the first feed line, the first feed line passing through the substrate from the first element to the ground plane.

22. An antenna as claimed in claim 1 further comprising a dielectric material on the substrate, the antenna being formed in a manner selected from the group consisting of: on the dielectric material, and in the dielectric material.

23. An antenna as claimed in claim 1, wherein the first portion, second portion and intermediate portion comprise a driven element; the driven element being outside a ribbon of exposed dielectric material, the antenna further comprising parasitic elements within the ribbon of exposed dielectric material, the parasitic elements being operatively connected to the driven elements by capacitive coupling.

24. An antenna-in-package comprising the antenna of claim 1.

25. An antenna-in-package comprising the antenna as claimed in claim 21, wherein the antenna-in-package further comprises a semiconductor chip mounted beneath the ground plane, the semiconductor chip having connects that are operatively connected to at least one selected from the group consisting of: the first feed line, and the first and second feed lines.

* * * * *